US008364046B2

(12) United States Patent
Ajima

(10) Patent No.: US 8,364,046 B2
(45) Date of Patent: Jan. 29, 2013

(54) IMAGE FORMING APPARATUS AND CONTROL PARAMETER CORRECTING METHOD

(75) Inventor: Hisanobu Ajima, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 242 days.

(21) Appl. No.: 12/752,809

(22) Filed: Apr. 1, 2010

(65) Prior Publication Data

US 2010/0254720 A1 Oct. 7, 2010

Related U.S. Application Data

(60) Provisional application No. 61/167,084, filed on Apr. 6, 2009.

(51) Int. Cl.
*G03G 15/00* (2006.01)

(52) U.S. Cl. ..... 399/12; 399/38; 399/50; 399/55

(58) Field of Classification Search ..... 399/9, 12, 399/13, 24–29, 38, 50, 53, 55
See application file for complete search history.

(56) References Cited

U.S. PATENT DOCUMENTS

| | | | | |
|---|---|---|---|---|
| 6,532,030 | B2 * | 3/2003 | Okano et al. | 347/131 |
| 6,546,214 | B2 * | 4/2003 | Sakai et al. | 399/38 |
| 7,295,787 | B2 | 11/2007 | Kikuchi | |
| 7,440,704 | B2 * | 10/2008 | Kobayashi | 399/12 |
| 7,440,808 | B2 | 10/2008 | Koichi | |
| 7,693,431 | B2 * | 4/2010 | Eda et al. | 399/9 |
| 2009/0021789 | A1 | 1/2009 | Sugimoto | |

* cited by examiner

*Primary Examiner* — Hoan Tran
(74) *Attorney, Agent, or Firm* — Patterson & Sheridan, LLP

(57) ABSTRACT

There is provided an image forming apparatus in which a correction value is acquired from a storage device provided in a coloring agent cartridge mounted in the image forming apparatus, it is determined whether the acquired correction value is within a specified numerical range, and when it is determined that the acquired correction value is not within the specified numerical range, a control parameter of a specified process relevant to an image forming operation is corrected based on a specified correction value previously set to correct the control parameter of the specified process performed by the image forming apparatus.

10 Claims, 10 Drawing Sheets

FIG. 3

| HDD 804 | |
|---|---|
| ADDRESS | INFORMATION CONTENT |
| A001 | CODE a |
| A002 | TABLE SELECTION CODE: "1" or "2" or "3" |
| A003 | TABLE WRITING AREA |

FIG. 4

| STORAGE DEVICE | |
|---|---|
| ADDRESS | INFORMATION CONTENT |
| B001 | CODE a |
| B002 | TABLE(1) |
| B003 | TABLE(2) |
| B004 | TABLE(3) |
| B005 | HISTORY WRITING AREA |

FIG. 5

TONER CHARACTERISTIC: FOR A

TABLE(1)

| SECTION | CORRECTION VALUE 1 | CORRECTION VALUE 2 | CORRECTION VALUE 3 |
|---|---|---|---|
| a | | | |
| b | | | |
| c | | | |
| d | | | |
| e | | | |
| f | | | |
| g | | | |
| h | | | |
| i | | | |
| j | | | |

TABLE(2)

| SECTION | CORRECTION VALUE 1 | CORRECTION VALUE 2 | CORRECTION VALUE 3 |
|---|---|---|---|
| a | | | |
| b | | | |
| c | | | |
| d | | | |
| e | | | |
| f | | | |
| g | | | |
| h | | | |
| i | | | |
| j | | | |

TABLE(3)

| SECTION | CORRECTION VALUE 1 | CORRECTION VALUE 2 | CORRECTION VALUE 3 |
|---|---|---|---|
| a | | | |
| b | | | |
| c | | | |
| d | | | |
| e | | | |
| f | | | |
| g | | | |
| h | | | |
| i | | | |
| j | | | |

TONER CHARACTERISTIC: FOR B

TABLE(1)

| SECTION | CORRECTION VALUE 1 | CORRECTION VALUE 2 | CORRECTION VALUE 3 |
|---|---|---|---|
| a | | | |
| b | | | |
| c | | | |
| d | | | |
| e | | | |
| f | | | |
| g | | | |
| h | | | |
| i | | | |
| j | | | |

TABLE(2)

| SECTION | CORRECTION VALUE 1 | CORRECTION VALUE 2 | CORRECTION VALUE 3 |
|---|---|---|---|
| a | | | |
| b | | | |
| c | | | |
| d | | | |
| e | | | |
| f | | | |
| g | | | |
| h | | | |
| i | | | |
| j | | | |

TABLE(3)

| SECTION | CORRECTION VALUE 1 | CORRECTION VALUE 2 | CORRECTION VALUE 3 |
|---|---|---|---|
| a | | | |
| b | | | |
| c | | | |
| d | | | |
| e | | | |
| f | | | |
| g | | | |
| h | | | |
| i | | | |
| j | | | |

TONER CHARACTERISTIC: FOR C

TABLE(1)

| SECTION | CORRECTION VALUE 1 | CORRECTION VALUE 2 | CORRECTION VALUE 3 |
|---|---|---|---|
| $a_1$ | | | |
| b | | | |
| c | | | |
| d | | | |
| e | | | |
| f | | | |
| g | | | |
| h | | | |
| i | | | |
| j | | | |

TABLE (2)

| SECTION | CORRECTION VALUE 1 | CORRECTION VALUE 2 | CORRECTION VALUE 3 |
|---|---|---|---|
| a | | | |
| b | | | |
| c | | | |
| d | | | |
| e | | | |
| f | | | |
| g | | | |
| h | | | |
| i | | | |
| j | | | |

TABLE(3)

| SECTION | CORRECTION VALUE 1 | CORRECTION VALUE 2 | CORRECTION VALUE 3 |
|---|---|---|---|
| a | | | |
| b | | | |
| c | | | |
| d | | | |
| e | | | |
| f | | | |
| g | | | |
| h | | | |
| i | | | |
| j | | | |

FIG. 10

REFERENCE TABLE (HDD 804 SIDE)

| SECTION | CORRECTION VALUE 1 | CORRECTION VALUE 2 | CORRECTION VALUE 3 |
|---|---|---|---|
| a | | | |
| b | | | |
| c | | | |
| d | | | |
| e | | | |
| f | | | |
| g | | | |
| h | | | |
| i | | | |
| j | | | |

IMAGE FORMING APPARATUS AND CONTROL PARAMETER CORRECTING METHOD

CROSS-REFERENCE TO RELATED APPLICATION

This application is based upon and claims the benefit of priority from: U.S. provisional application 61/167,084, filed on Apr. 6, 2009, the entire contents of each of which are incorporated herein by reference.

TECHNICAL FIELD

The present invention relates to control of a process performed by an image forming apparatus in relation to information stored in a storage medium provided in a toner cartridge.

BACKGROUND

Hitherto, there is known a structure in which information stored in a storage medium provided in a toner cartridge mounted in an image forming apparatus is read, and an image forming apparatus main body uses the information.

When the structure of the related art is adopted, when the information of the storage medium provided in the toner cartridge is broken by static electricity, or erroneous data is written due to occurrence of a write miss or the like at the time of manufacture, or when no data is written, there is a fear that an erroneous operation is caused on the image forming apparatus side.

SUMMARY

In order to solve the problem, according to an aspect of the present invention, in an image forming apparatus in which a coloring agent cartridge including a storage device to store a correction value for correcting a control parameter of a specified process relevant to an image forming operation is mounted, the image forming apparatus includes a correction information acquisition section to acquire the correction value from the storage device provided in the coloring agent cartridge mounted in the image forming apparatus, a determination section to determine whether the correction value acquired by the correction information acquisition section is within a specified numerical range, a storage section to store a specified correction value previously set to correct the control parameter of the specified process performed by the image forming apparatus, and a correction processing section to correct the control parameter of the specified process relevant to the image forming operation based on the specified correction value stored in the storage section when the determination section determines that the correction value acquired by the correction information acquisition section is not within the specified numerical range.

According to another aspect of the invention, in a control parameter correcting method of an image forming apparatus in which a coloring agent cartridge including a storage device to store a correction value for correcting a control parameter of a specified process relevant to an image forming operation is mounted, the control parameter correcting method includes acquiring the correction value from the storage device provided in the coloring agent cartridge mounted in the image forming apparatus, determining whether the acquired correction value is within a specified numerical range, and correcting the control parameter of the specified process relevant to the image forming operation based on a specified correction value previously set to correct the control parameter of the specified process performed by the image forming apparatus when it is determined that the acquired correction value is not within the specified numerical range.

DESCRIPTION OF THE DRAWINGS

FIG. 3 is a view for explaining correction data stored in a HDD 804.

FIG. 4 is a view for explaining data stored in storage devices 9Y to 9K provided in toner cartridges 1Y to 1K.

FIG. 5 is a view for explaining the details of information stored in the storage device of the toner cartridge.

FIG. 10 is a view for explaining a reference table stored in a HDD 804.

DETAILED DESCRIPTION

Hereinafter, embodiments will be described with reference to the drawings.

First Embodiment

Figure 1:
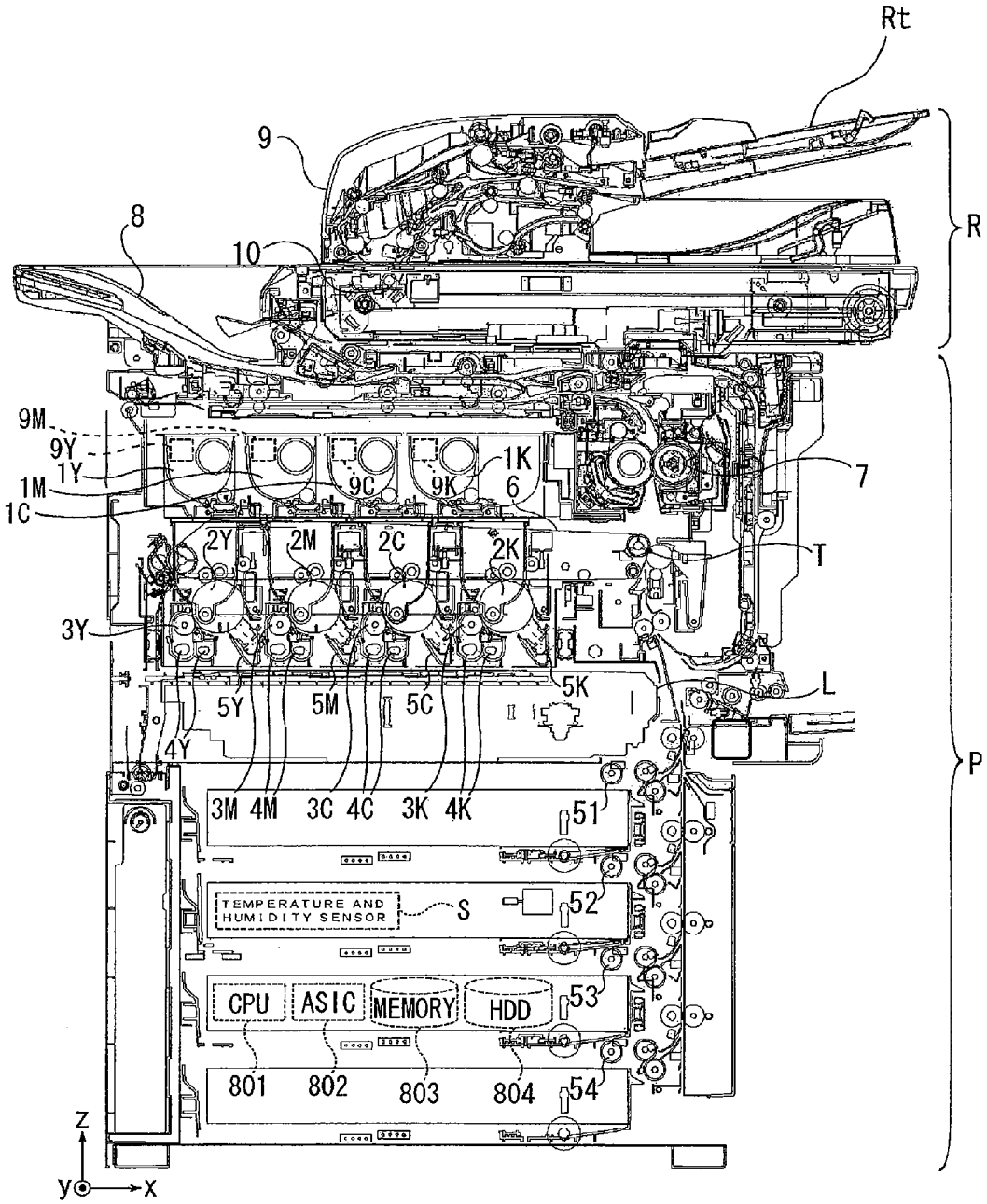
FIG. 1 is a vertical sectional view showing a schematic structure of an image forming apparatus (MFP: Multi Function Peripheral) of a first embodiment of the invention.

FIG. 1 is a vertical sectional view showing a schematic structure of an image forming apparatus (MFP: Multi Function Peripheral) of a first embodiment of the invention.

As shown in FIG. 1, the image forming apparatus of this embodiment includes an image reading section R and an image forming section P.

The image reading section R has a function to scan and read an image of a sheet document and a book document.

The image forming section P has a function to form a developer image on a sheet based on an image read from a document by the image reading section R, image data transmitted to the image forming apparatus from an external equipment, or the like.

The image reading section R includes an auto document feeder (ADF) 9 capable of automatically feeding a document to a specified image reading position. A scanning optical system 10 reads a document placed on a document tray (a specified document placement table) Rt and automatically fed by the auto document feeder 9 or an image of a document placed on a not-shown document table.

Besides, the image forming section P includes pickup rollers 51 to 54, photoreceptors 2Y to 2K, developing rollers 3Y to 3K, mixers 4Y to 4K, an intermediate transfer belt 6, a fixing device 7, a discharge tray 8, toner cartridges 1Y to 1K (coloring agent cartridges) and a laser unit L.

Besides, the image forming apparatus of this embodiment includes a CPU 801, an ASIC (Application Specific Integrated Circuit) 802, a MEMORY 803 and a HDD (Hard Disk Drive) 804 (see FIG. 1). The CPU 801 functions to perform various processes in the image forming apparatus, and performs programs stored in the MEMORY 803 to realize various functions. Incidentally, it is needless to say that the CPU 801 can be replaced by an MPU (Micro Processing Unit) which can execute an equivalent arithmetic operation. Besides, similarly, the HDD 804 can be replaced by a storage device such as a flash memory, for example.

The MEMORY 803 can be constituted of, for example, a RAM (Random Access Memory), a ROM (Read Only Memory), a DRAM (Dynamic Random Access Memory), a SRAM (Static Random Access Memory), a VRAM (Video Ram) or the like, and has a function to store various information and programs used in the image forming apparatus.

Besides, the image forming apparatus of this embodiment includes a temperature and humidity sensor S, and can measure temperature (° C.) and relative humidity (%) as a temperature and humidity environment to which the image forming apparatus is exposed. The image forming apparatus of this embodiment performs adjustment of various control parameters and the like based on the measurement result of the temperature and humidity sensor S.

Besides, in this embodiment, the respective toner cartridges 1Y to 1K can be individually detached from and attached to the image forming apparatus main body. The toner cartridges 1Y to 1K are respectively integrally provided with storage devices 9Y to 9K. The storage devices 9Y to 9K store correction information corresponding to the characteristics of toners contained in the respective toner cartridges. The image forming apparatus can perform mutual data communication with the storage devices 9Y to 9K of the toner cartridges 1Y to 1K through wired communication or wireless communication.

Besides, the HDD 804 (storage section) previously stores specified identification information, such as serial number, to identify the toner cartridge to be mounted in the image forming apparatus of this embodiment. Besides, the HDD 804 stores a specified correction value previously set to correct a control parameter of a specified process performed by the image forming apparatus.

Hereinafter, as an example of a process in the image forming apparatus of this embodiment, the outline of a copy process will be described.

First, a sheet picked up by the pickup rollers 51 to 54 from a cassette is supplied to a sheet conveyance path. The sheet supplied to the sheet conveyance path is conveyed in a specified conveyance direction by plural roller pairs.

Images of plural sheet documents continuously automatically fed by the auto document feeder 9 are read by the scanning optical system 10 at the specified image reading position.

Next, electrostatic latent images are formed by the laser unit L on the photosensitive surfaces of the photoreceptors 2Y, 2M, 2C and 2K for transferring developer images of yellow (Y), magenta (M), cyan (C) and black (K) to a sheet based on image data of images read from the document by the image reading section R.

Subsequently, developers agitated by the mixers 4Y to 4K (corresponding to agitating sections) in a developing unit are supplied, by the developing rollers 3Y to 3K (so-called mag-roller), to the photoreceptors 2Y to 2K on which the electrostatic latent images are formed as stated above. By this, the electrostatic latent images formed on the photosensitive surfaces of the photoreceptors are developed. The toner cartridges 9Y to 9K replenish the toners to these developing units.

Developer images formed in this way on the photoreceptors are transferred (so-called primary transfer) onto the belt surface of the intermediate transfer belt 6, and the developer images conveyed by the rotation of the intermediate transfer belt are transferred onto the conveyed sheet at a specified secondary transfer position T.

The developer images transferred on the sheet are heated and fixed to the sheet by the fixing unit 7.

The sheet on which the developer images are heated and fixed is conveyed in the conveyance path by plural conveyance roller pairs, and is successively discharged onto the discharge tray 8.

Incidentally, in the image forming apparatus of this embodiment, the CPU 801 reads correction information from the storage devices 9Y to 9K provided in the toner cartridges 1Y to 1K mounted in the image forming apparatus main body. Based on the correction information acquired from the storage devices 9Y to 9K, the CPU 801 basically performs control of the laser output of the laser unit L, control of the voltage value of developing bias voltage applied to the developing rollers 3Y to 3K in the developing unit, and control of the charge bias in charger units 5Y to 5K.

As described above, in the image forming apparatus of this embodiment, the control parameters of the specified processes relevant to the image forming operation are corrected based on the correction values stored in the storage devices provided in the toner cartridges mounted in the image forming apparatus main body.

Figure 2:
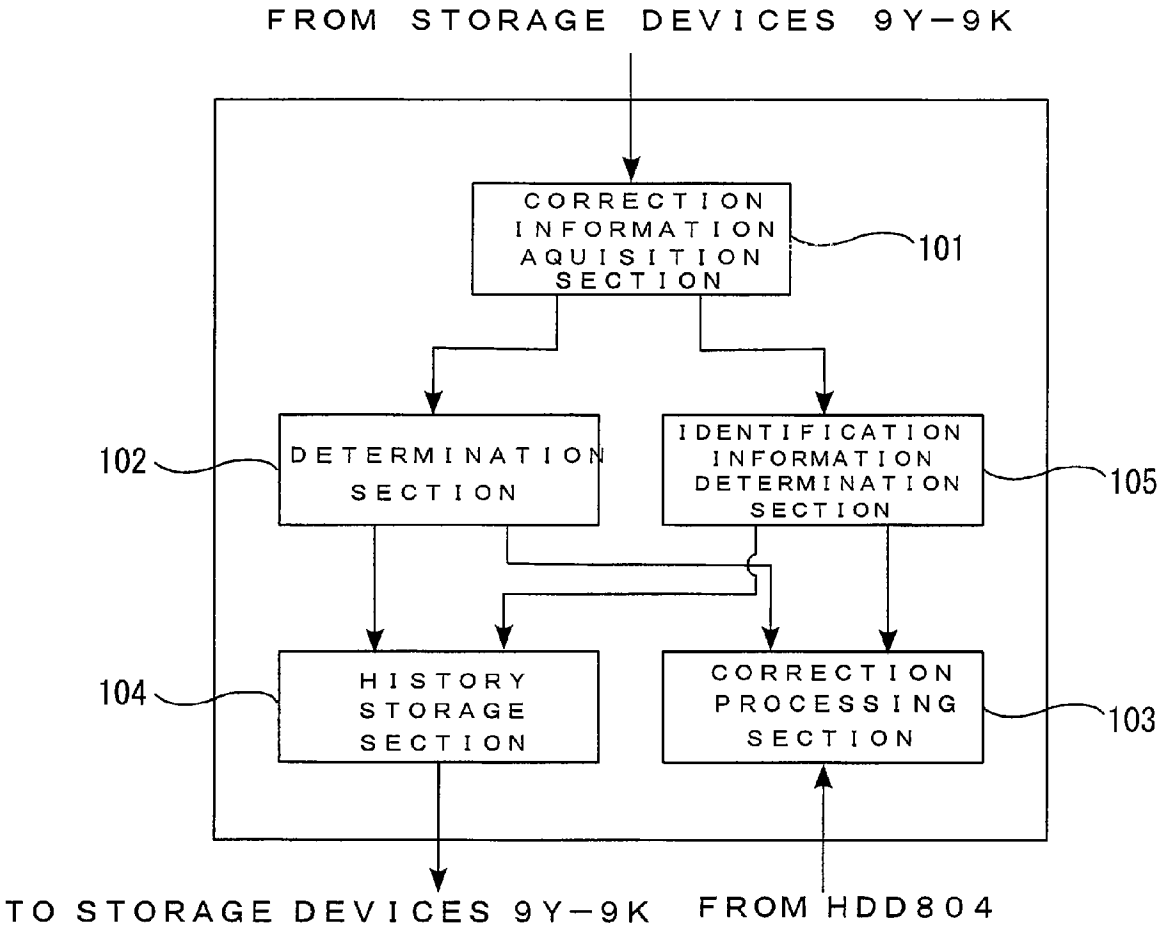
FIG. 2 is a functional block diagram for explaining various functions of the image forming apparatus of the first embodiment of the invention.

FIG. 2 is a functional block diagram for explaining various functions of the image forming apparatus of the first embodiment of the invention.

The respective functions of the image forming apparatus shown in FIG. 2 are realized, for example, by causing the CPU 801 to execute various programs, such as a control parameter correction program, stored in the MEMORY 803.

A correction information acquisition section 101 acquires correction values from the storage devices 9Y to 9K provided in the toner cartridges 1Y to 1K mounted in the image forming apparatus of this embodiment via wired or wireless communication path.

A determination section 102 determines whether the correction value acquired by the correction information acquisition section 101 is within a specified numerical range.

When the determination section 102 determines that the correction value acquired by the correction information acquisition section 101 is not within the specified numerical range, a correction processing section 103 corrects the control parameter of the specified process relevant to the image forming operation based on the specified correction value stored in the HDD 804.

A history storage section 104 stores the information relating to the determination result of the determination section 102 into the storage device provided in the toner cartridge which is the determination object of the determine process in which the determination result is obtained.

As stated above, the result of the numerical determination on the correction value stored in the storage device of the toner cartridge is stored in the storage device, so that a process such as a suitable parameter correction can be performed when the image forming process using the toner contained in the toner cartridge is performed later.

When the storage device provided in the toner cartridge stores identification information for identifying the toner cartridge, a identification information determination section 105 determines whether the identification information is coincident with specified identification information stored in the HDD 804.

When the identification information determination section 105 determines that the identification information stored in the storage device is not coincident with the specified identification information, the correction processing section 103 corrects the control parameter of the specified process relevant to the image forming operation based on the specified correction value stored in the HDD 804.

As shown in FIG. 3, the HDD 804 installed in the image forming apparatus main body side can store three or more kinds of correction data, and the addresses of the three or more kinds of correction data are made A001, A002 and A003. Besides, as shown in FIG. 4, each of the storage devices 9Y to 9K provided in the toner cartridges 1Y to 1K can store five or more kinds of data, and addresses at which the data are stored are made B001, B002, B003, B004 and B005.

An identification code is inputted at A001 and is used for comparison with B001. Based on the comparison process, the CPU 801 determines whether the toner cartridge is a legitimate product which can be used in the image forming apparatus of this embodiment.

A002 represents an input area of a selection code of a correction control table, and holds one of "1", "2" and "3" as the selection code. In a writing area of A003, one of tables at "B002", "B003" and "B004" is written as the correction control table selected by the selection code.

Besides, a history writing area is provided at "B005", and when the control parameter is corrected using control information stored in the HDD 804 by some reason, the history information indicating to that effect is written.

The form of the information is arbitrary as long as identification can be performed, and a simple structure can be adopted, for example, "01" when there is information, and "00" when there is no information.

FIG. 5 is a view for explaining the details of information stored in the storage devices 9Y to 9K on the toner cartridge side.

Specifically, addresses "B002" to "B004" at which tables (1) to (3) for correction control corresponding to toner characteristics (A to C) are secured in the storage devices 9Y to 9K of the toner cartridges 1Y to 1K. The toner characteristic is measured at the time of toner production, and one of tables of "toner characteristic: for A", "toner characteristic: for B" and "toner characteristic: for C" is written according to the measured toner characteristic.

The tables (1) to (3) have table structures in which correction values are different from each other, and the table (1) has standard correction values, the table (2) has correction values lower than those of the table (1), and the table (3) has correction values higher than those of the table (1). In this structure, fine adjustment of the control value (correction value) can be performed by changing the access destination of the CPU 801 of the image forming apparatus main body.

In this embodiment, the toner characteristic is classified into ranks based on the resistance value of toner. Specifically, "toner characteristic: for A" is adopted when the toner resistance value is 8.0 to 12.0 (Ωcm*10^10), "toner characteristic: for B" is adopted when the toner resistance value is 4.0 to 7.9 (Ωcm*10^10), and "toner characteristic: for C" is adopted when the toner resistance value is 12.1 to 16.0 (Ωcm*10^10).

With respect to the data in each of the data tables (1) to (3), the relative humidity detected by the temperature and humidity sensor S provided in the image forming apparatus main body is divided into ten sections of a to j, and correction values 1 to 3 are assigned to each of the sections.

Specifically, the "correction value 1" represents a correction value of a voltage value of charging bias voltage when the photoconductive drum is charged, the "correction value 2" represents a correction value of a voltage value of development bias voltage when a toner image is transferred to a recording medium, and the "correction value 3" represents a correction value of laser output used for exposure of the photosensitive surface of the photoconductive drum. In this way, the plural kinds of correction tables corresponding to the toner characteristic measured at the time of production can be held.

Hereinafter, a specific measuring method of the toner resistance value will be described.

In this embodiment, a toner of 3 g is filled in a shaping unit of ϕ5 cm, a plate obtained by pressure shaping for 10 minutes at a pressure of 300 kN is set on a solid-state electrode (made by Ando Electric Co., Ltd.: SE-71), and measurement is performed under conditions of 1.00 khz and 5.00 v by using an LCR meter (made by Ando Electric Co., Ltd.: AG-4311) in a constant temperature bath (made by Ando Electric Co., Ltd.: TO-9B). A value obtained by using Cx (capacitance [pF]) obtained by the above measurement, Gx (conductance [μs]) and the thickness [tx] of the shaped toner and by the following numerical expression is made the resistance value of the toner. In the following expression, "11.34" corresponds to the contact area of the solid-state electrode to the toner plate.

$$\text{toner resistance value } \rho=(11.34/Gx\cdot tx)\times 1011$$

Figure 6:
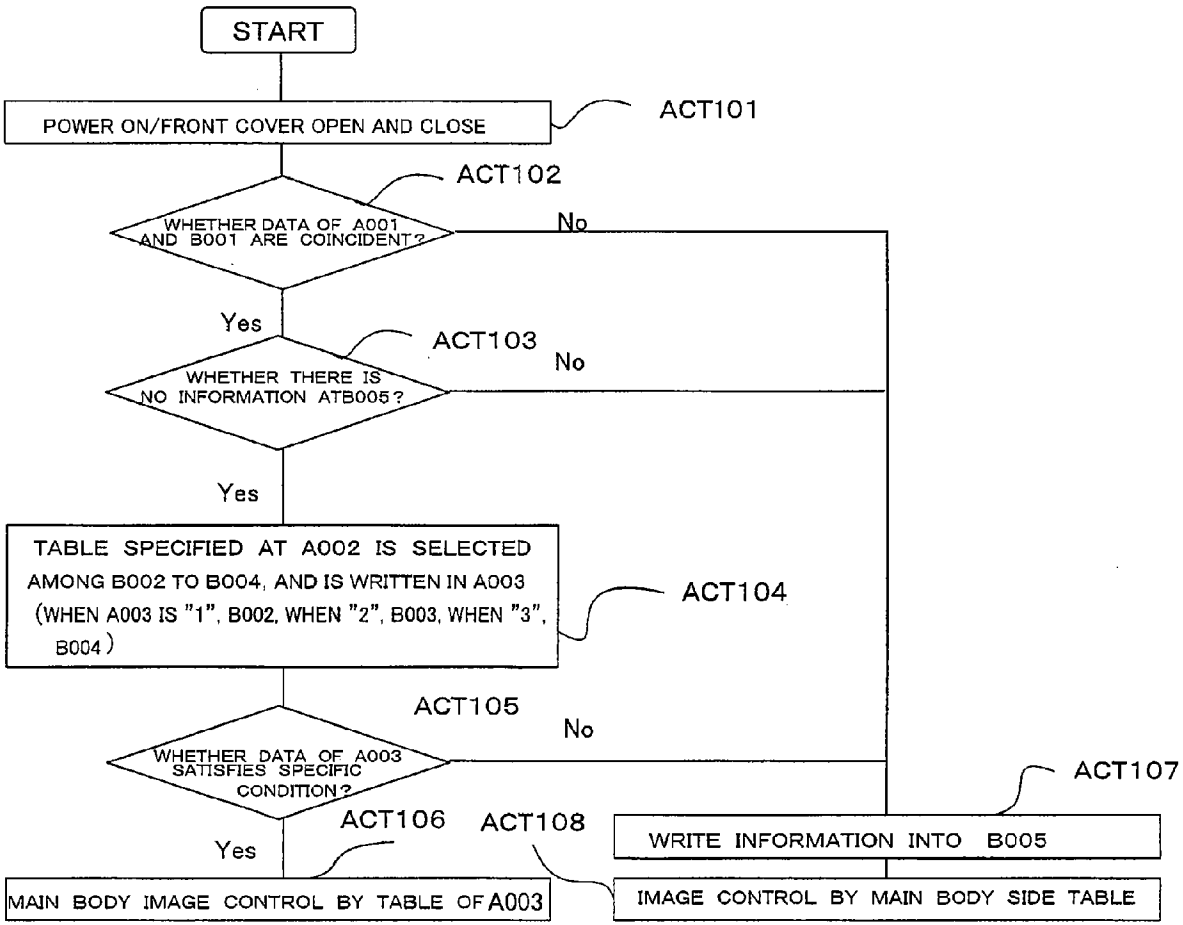
FIG. 6 is a flowchart showing a flow of a process in the image forming apparatus of the first embodiment of the invention.

FIG. 6 is a flowchart showing a flow of a process in the image forming apparatus of the first embodiment of the invention.

When the power source of the image forming apparatus main body is turned ON, or when the toner cartridge is replaced and the front cover of the apparatus (the cover opened and closed when the toner cartridge is replaced) is closed (ACT 101), the CPU 801 detects that the front cover is closed, and performs data comparison between A001 and B001 (ACT 102).

As a result of the comparison, when the data are coincident with each other (ACT 102, Yes), it is confirmed whether information is written at B005 (ACT 103). On the other hand, when the data are not coincident with each other (ACT 102, No), the table specified at A002 is selected from B002 to B004 and is written in A003. At this time, when A002 represents "1", B002 is written, when "2", B003 is written, and when "3", B004 is written (ACT 104).

Next, it is confirmed whether the data written in A003 satisfies a specific condition (ACT 105). Although the specific condition can be made, for example, a restriction condition such as $$50 \geqq \text{Data} \geqq 3,$$

the condition may be represented by, for example, a numerical expression instead of this.

As a result of the confirmation, only when the data written in A003 satisfies the specific condition (ACT 105, Yes), the control of the image forming apparatus is performed using the data written in the address "A003" of the HDD 804.

Besides, in the case of "No" at ACT 102, ACT 103 and ACT 105 of the flow, the CPU 801 writes history information in the storage area of the address "B005" of the HDD 804.

As stated above, according to this embodiment, also when normal information for correction control can not be acquired from the storage device provided in the toner cartridge, the occurrence of a defect in the image forming apparatus can be avoided by performing the control using the control data stored in the HDD 804 provided in the image forming apparatus main body.

Second Embodiment

Next, a second embodiment of the invention will be described.

The second embodiment of the invention is a modified example of the first embodiment. Hereinafter, in this embodiment, a portion having the same function as a portion described in the first embodiment is denoted by the same reference numeral and its description is omitted.

Figure 7:
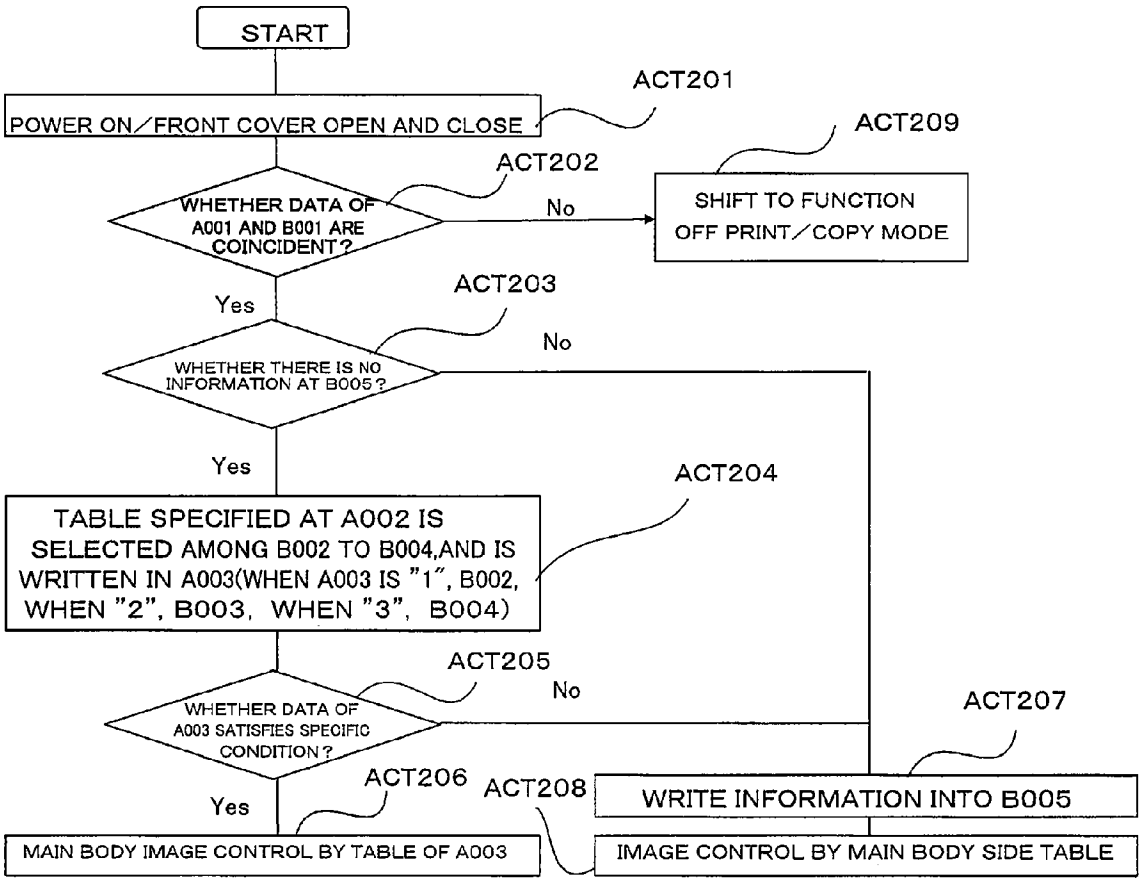
FIG. 7 is a flowchart showing an example in which when a determination result at ACT 102 in the flowchart shown in FIG. 6 is "No", shift is made to a print/copy mode in a state where no correction table is used.

FIG. 7 is a flowchart showing an example in which when the determination result at ACT 102 in the flowchart shown in FIG. 6 is "No", shift is made to a print/copy mode in a state (function OFF) where no correction table is used (ACT 209).

In FIG. 7, the contents of ACT 201 to ACT 208 are the same as those of ACT 101 to ACT 108 shown in FIG. 6.

Third Embodiment

Next, a third embodiment of the invention will be described.

The third embodiment of the invention is a modified example of the foregoing respective embodiments. Hereinafter, in this embodiment, a portion having the same function as a portion described in the foregoing respective embodiments is denoted by the same reference numeral and its description is omitted.

Figure 8:
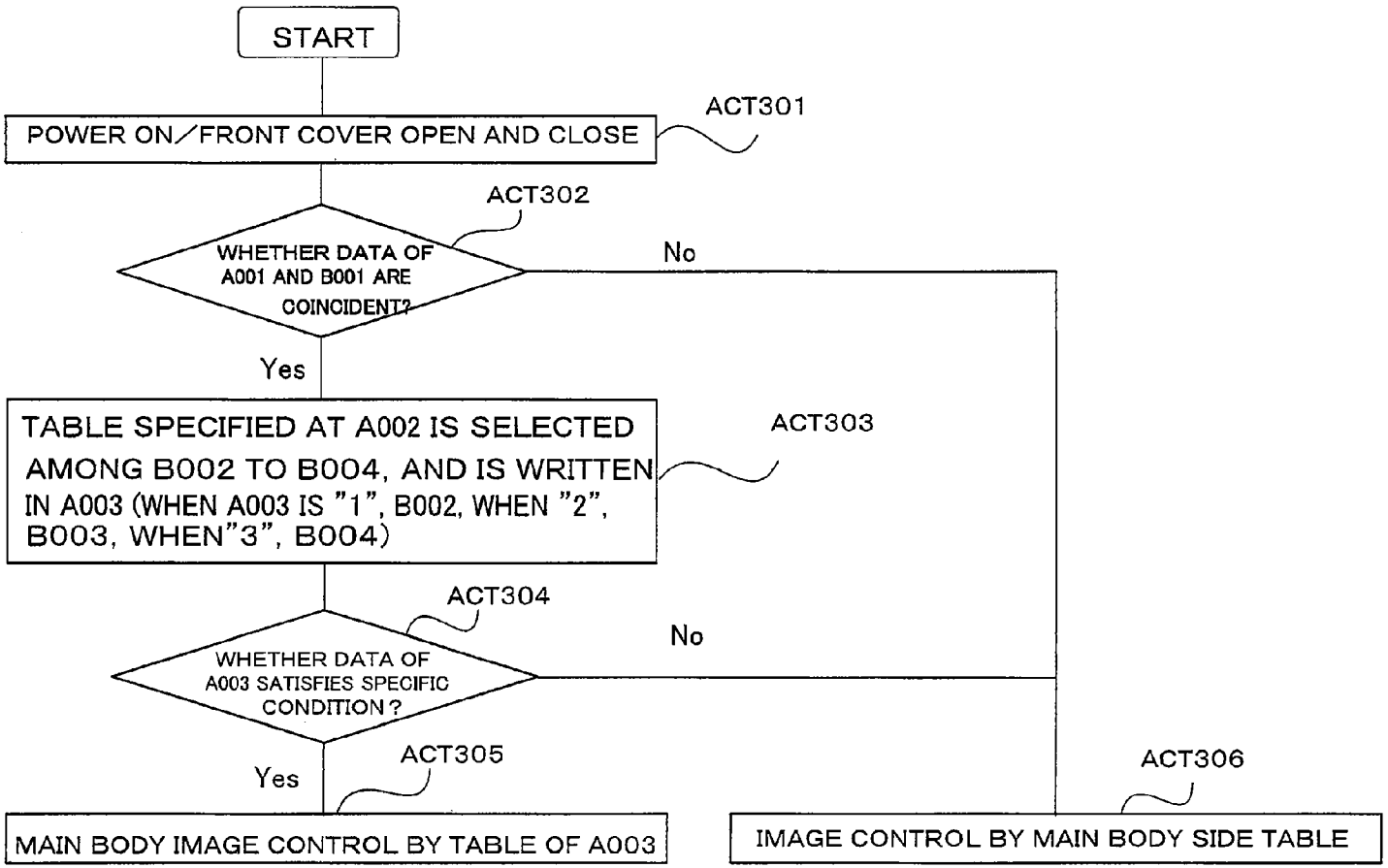
FIG. 8 is a flowchart in which the process of ACT 102 is eliminated in the flowchart shown in FIG. 6.

FIG. 8 is a flowchart in which the process of ACT 102 is eliminated in the flowchart shown in FIG. 6.

In FIG. 8, the contents of ACT 301 to ACT 302, ACT 303 to ACT 305 and ACT 306 are the same as those of ACT 101 to ACT 102, ACT 104 to ACT 106 and ACT 108 shown in FIG. 6.

In this embodiment, although reference is not made to the history of "B005", since the determination section performs determination of "whether data at A003 satisfies specific condition?" (ACT 304), the structure resultantly becomes the same as that of FIG. 6.

Fourth Embodiment

Next, a fourth embodiment of the invention will be described.

The fourth embodiment of the invention is a modified example of the foregoing respective embodiments. Hereinafter, in this embodiment, a portion having the same function as a portion described in the foregoing respective embodiments is denoted by the same reference numeral and its description is omitted.

Figure 9:
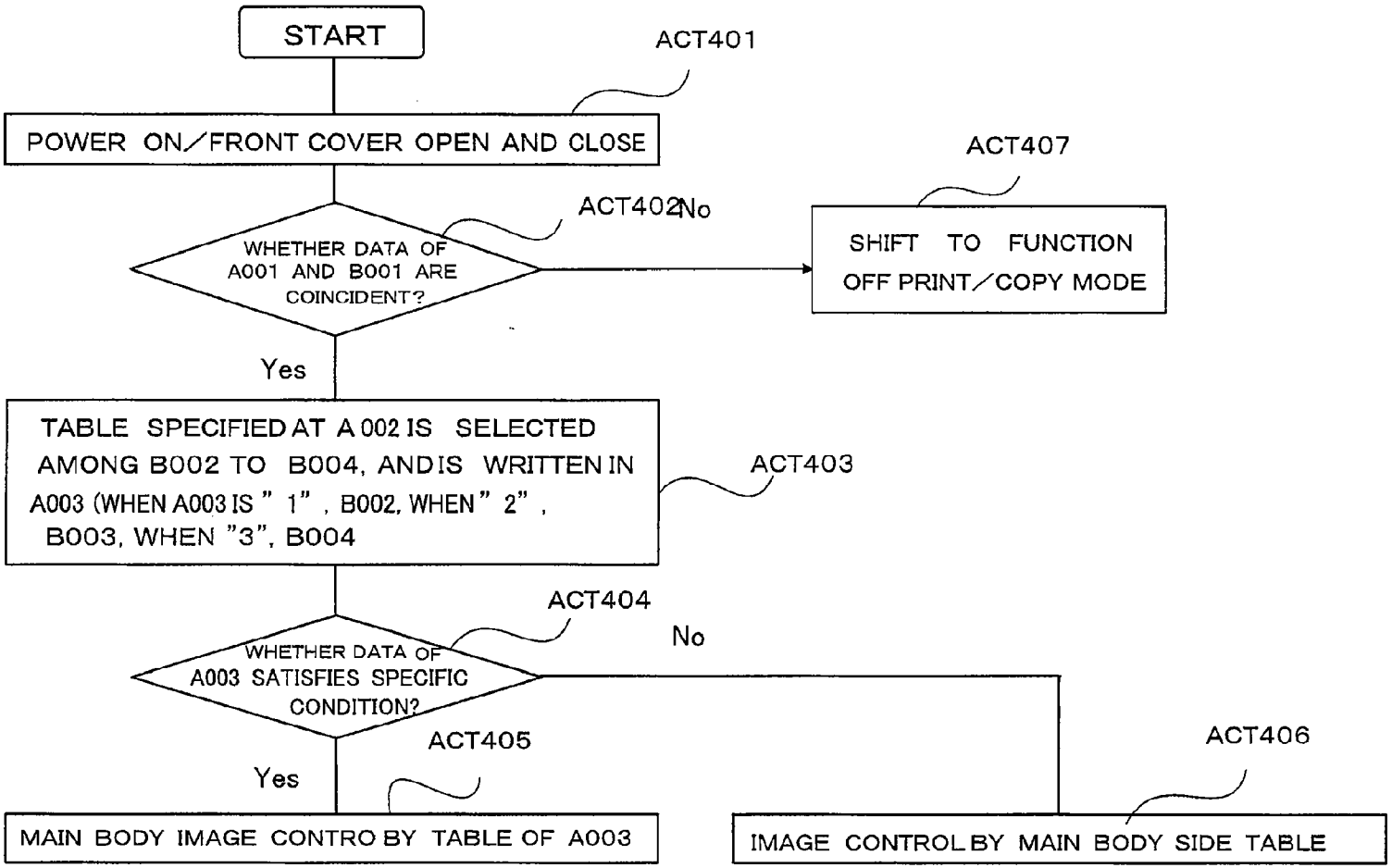
FIG. 9 is a flowchart in which when the determination of "whether data of A001 and B001 are coincident?" in the flowchart shown in FIG. 8 is "No", shift is made to a function OFF print mode.

FIG. 9 is a flowchart in which when the determination of "data of A001 and B001 are coincident?" (ACT 302) in the flowchart shown in FIG. 8 is "No", shift is made to a function OFF (no correction table is used) print mode (ACT 407).

In FIG. 9, the contents of ACT 401 to ACT 406 are the same as those of ACT 301 to ACT 306 shown in FIG. 8.

In this embodiment, the numerical range to be adopted when the correction value stored in the storage device of the toner cartridge is normal is made $$50 \geqq \text{Data} \geqq 3.$$

As values of the correction values in this embodiment, a correction value 1 (correction value of charge bias), a correction value 2 (correction value to developing bias), and a correction value 3 (correction value to laser output) are enumerated. Besides, each of these correction values is a value within a numerical range of 5 to 48 (FIG. 10). These correction values are recorded as a data table in the storage area of the storage device provided in the toner cartridge.

Next, the data table stored in the storage area of the storage device provided in the toner cartridge will be described.

A reference data table is written in the HDD 804 provided in the image forming apparatus main body, and is used for the correction of the control parameter when the "image control at the main body side table" (ACT 108, ACT 208, ACT 306) is performed when the determination of "whether data at A003 satisfies specific condition" (ACT 105, ACT 205, ACT 304) in the operation flow of FIG. 6 to FIG. 9 is "No".

Incidentally, when the numerical value in the data table exceeds "50≧Data≧3", control is performed using the reference table stored in the HDD 804 shown in FIG. 10.

For example, when "100" outside the normal numerical range is written as the numerical value of the correction value 1 by some reason, the reference table stored in the HDD 804 on the main body side is used, and a defect which can occur can be avoided.

Incidentally, in the foregoing respective embodiments, although the structure is described in which the toner cartridge is provided with the storage device, no limitation is made to this. For example, it is needless to say that a structure in which the storage medium in the foregoing respective embodiments is provided in a fixing unit or a photoreceptor or the like can be adopted. Besides, when an image forming apparatus having an ink-jet type image forming function is adopted, the invention can be applied by mounting the storage medium in an ink cartridge (ink tank).

Besides, in the foregoing embodiments, although the example in which the correction value of the control parameter is a numerical value is described, no limitation is made to this. The correction value may be a symbol or the like as long as the information enables the image forming apparatus side to finally specify the content of correction to be performed on the control parameter.

Besides, in the foregoing embodiments, although the determination on the correction value acquired by the correction information acquisition section is performed based on whether it is within the specified numerical range, no limitation is made to this. For example, when the correction value is a content determined to a certain degree, it may be determined whether the acquired correction value is normal based on whether the correction value is coincident with the content.

Besides, in the foregoing embodiments, although the structure is exemplified in which the specified correction value substituted when the correction value acquired from the cartridge side is not normal is stored in the storage device provided in the image forming apparatus, no limitation is made to this. For example, data is stored in a storage area of an external equipment, such as a server, which can communicate with the image forming apparatus of the foregoing embodiment, and the data may be acquired via a network when necessary.

Besides, the specified correction value previously stored in the HDD 804 of the image forming apparatus may be updated via, for example, a network according to the change of physical properties of toner usable in the image forming apparatus.

Besides, for example, when a correction value stored in a storage device of one of the toner cartridges of Y, M, C and K is not normal, a correction value of another cartridge in which a normal correction value is stored may be adopted also for the cartridge in which the normal correction value can not be acquired.

Further, a program to cause the processor, such as the CPU 801 (or MPU which can be substituted for it), constituting the image forming apparatus to execute the foregoing respective operations can be provided as a control parameter correcting method program. In this embodiment, although the case is exemplified in which the program for realizing the function to carry out the invention is previously recorded in the storage area provided in the inside of the apparatus, no limitation is made to this. A similar program may be downloaded from a network to the apparatus, or a computer readable recording medium storing a similar program may be installed in the apparatus. The form of the recording medium is arbitrary as long as the program can be stored and can be read by a computer. Specifically, as the recording medium, for example, an inner storage device mounted in the inside of the computer, such as a ROM or a RAM, a portable storage medium such as a CD-ROM, a flexible disk, a DVD disk, a magneto-optical disk or an IC card, a database to hold computer programs, another computer and its database, a transmission medium on a line, and the like can be enumerated. The function obtained by the previous installation or download may be realized in cooperation with an OS (Operating System) in the inside of the apparatus.

Incidentally, the program may be an execution module in which a part or the whole thereof is dynamically created.

Besides, it is needless to say that various processes realized by causing the CPU or the MPU to execute the program in the foregoing respective embodiments can also be executed in the ASIC 802 by circuits.

The present invention can be carried out in various forms without departing from the sprit or the principal feature. Thus, the foregoing embodiments are merely exemplary in all points and should not be restrictedly interpreted. The scope of the invention is defined by the claims and is not restricted by the text of the specification. Further, all modifications, various improvements, substitutions and alterations within the equivalent range of the claims are within the scope of the invention.

As described above in detail, according to the foregoing embodiments, it is possible to provide the technique to prevent an erroneous operation from occurring on the image forming apparatus side when there is a defect in the information stored in the storage medium provided in the toner cartridge.

What is claimed is:

1. An image forming apparatus in which a coloring agent cartridge including a storage device to store a correction value for correcting a control parameter of a specified process relevant to an image forming operation is mounted, comprising:

a correction information acquisition section to acquire the correction value from the storage device provided in the coloring agent cartridge mounted in the image forming apparatus;

a determination section to determine whether the correction value acquired by the correction information acquisition section is within a specified numerical range;

a storage section to store a specified correction value previously set to correct the control parameter of the specified process performed by the image forming apparatus; and a correction processing section to correct the control parameter of the specified process relevant to the image forming operation based on the specified correction value stored in the storage section when the determination section determines that the correction value acquired by the correction information acquisition section is not within the specified numerical range.

2. The apparatus of claim 1, wherein the coloring agent cartridge is a toner cartridge, and the control parameter of the specified process is one of a voltage value of a charging bias voltage when a photoconductive drum is charged, a voltage value of a developing bias voltage when a toner image is transferred to a recording medium, and an intensity of laser light when a photosensitive surface of the photoconductive drum is exposed.

3. The apparatus of claim 1, further comprising a history storage section to store information relating to a determination result of the determination section into the storage device provided in the coloring agent cartridge as a determination object of a determination process in which the determination result is obtained.

4. The apparatus of claim 1, wherein the storage section previously stores specified identification information for identifying the coloring agent cartridge to be mounted in the image forming apparatus, an identification information determination section determines whether, when identification information for identifying the coloring agent cartridge is stored in the storage device provided in the coloring agent cartridge, the identification information is coincident with the specified identification information stored in the storage section, and when the identification information determination section determines that the identification information stored in the storage device is not coincident with the specified identification information, the correction processing section corrects the control parameter of the specified process relevant to the image forming operation based on the specified correction value stored in the storage section.

5. The apparatus of claim 1, wherein the correction value from the storage device and the specified correction value relate to the same kind of information.

6. A control parameter correcting method of an image forming apparatus in which a coloring agent cartridge including a storage device to store a correction value for correcting a control parameter of a specified process relevant to an image forming operation is mounted, comprising:

acquiring the correction value from the storage device provided in the coloring agent cartridge mounted in the image forming apparatus;

determining whether the acquired correction value is within a specified numerical range; and correcting the control parameter of the specified process relevant to the image forming operation based on a specified correction value previously set to correct the control parameter of the specified process performed by the image forming apparatus when it is determined that the acquired correction value is not within the specified numerical range.

7. The method of claim 6, wherein the coloring agent cartridge is a toner cartridge, and the control parameter of the specified process is one of a voltage value of a charging bias voltage when a photoconductive drum is charged, a voltage value of a developing bias voltage when a toner image is transferred to a recording medium, and an intensity of laser light when a photosensitive surface of the photoconductive drum is exposed.

8. The method of claim 6, wherein information relating to a determination result as to whether the acquired correction value is within the specified numerical range is stored in the storage device provided in the coloring agent cartridge as a determination object of a determination process in which the determination result is obtained.

9. The method of claim 6, wherein when identification information for identifying the coloring agent cartridge is stored in the storage device provided in the coloring agent cartridge, it is determined whether the identification information is coincident with specified identification information for identifying the coloring agent cartridge to be mounted in the image forming apparatus, and when it is determined the identification information stored in the storage device is not coincident with the specified identification information, the control parameter of the specified process relevant to the image forming operation is corrected based on the specified correction value.

10. The method of claim 6, wherein the correction value from the storage device and the specified correction value relate to the same kind of information.

* * * * *